US011615771B2

(12) United States Patent
Liao

(10) Patent No.: US 11,615,771 B2
(45) Date of Patent: Mar. 28, 2023

(54) DRUM SNARE ADJUSTER WITH ANTI-LOOSENESS STRUCTURE

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 105 days.

(21) Appl. No.: 17/358,423

(22) Filed: Jun. 25, 2021

(65) Prior Publication Data

US 2022/0415288 A1 Dec. 29, 2022

(51) Int. Cl.
*G10D 13/18* (2020.01)
*G10D 13/02* (2020.01)

(52) U.S. Cl.
CPC ..... *G10D 13/18* (2020.02); *G10D 13/02* (2013.01)

(58) Field of Classification Search
CPC ..... G10D 13/18; G10D 13/02
See application file for complete search history.

(56) References Cited

U.S. PATENT DOCUMENTS 4,246,825 A * 1/1981 Hodas ..... G10D 13/02 84/415
6,846,978 B2 * 1/2005 Dorfman ..... G10D 13/02 84/411 R
7,220,905 B2 * 5/2007 Takegawa ..... G10D 13/02 84/415
9,269,337 B2 * 2/2016 Sato ..... G10D 13/02
9,934,766 B2 * 4/2018 Murray ..... G10D 13/02
2004/0168563 A1 * 9/2004 Dorfman ..... G10D 13/18 84/415
2015/0317962 A1 * 11/2015 Mihos ..... G10D 13/02 84/417

* cited by examiner

*Primary Examiner* — Robert W Horn
(74) *Attorney, Agent, or Firm* — Muncy, Geissler, Olds & Lowe, P.C.

(57) ABSTRACT

The present invention provides a drum snare including a fixed seat, an actuation column, an actuation handle, a pull-down seat, an adjustment bolt, and a packing assembly. The actuation handle passes through a lateral hole to connect and fix to the actuation column. The lateral hole includes two snap-in slots pressing against the actuation handle. The pull-down seat includes a clamping seat and a non-circular rod body passing through the fixed seat in a non-rotation manner. The non-circular rod body includes an internal thread hole. The adjustment bolt is rotatably fixed on the actuation column. The adjustment bolt includes a thread section penetrating in the internal thread hole. The packing assembly is provided between the adjustment bolt and the actuation column. Therefore, a friction force between the adjustment bolt and the actuation column is increased through the packing assembly, and looseness of the adjustment bolt can be avoided.

8 Claims, 5 Drawing Sheets

DRUM SNARE ADJUSTER WITH ANTI-LOOSENESS STRUCTURE

FIELD OF THE INVENTION

The present invention relates to a drum snare adjuster, in particular to a drum snare adjuster with an anti-looseness structure.

BACKGROUND OF THE INVENTION

A drum snare adjuster is used to adjust the tightness of a snare under a drum. For example, the U.S. Pat. No. 6,846,978 B2, entitled "Strainer for a drum", changes the strain of the string by using an adjuster provided on a drum frame of the drum. After the tightness of the snare is changed, a sound made by hitting the drum will also change to meet needs for usage.

A conventional drum snare adjuster usually has an actuation handle and an adjustment bolt. The actuation handle controls whether to strain the snare, and the adjustment bolt is used to finely adjust the tightness of the snare. In practice, since the drum vibrates continuously when it is hit, the adjustment bolt may be gradually loosened, and often needs to be adjusted.

SUMMARY OF THE INVENTION

The main purpose of the present invention is to provide a drum snare adjuster with an anti-looseness structure to satisfy needs of usage.

In order to achieve the above purpose, a drum snare adjuster with an anti-looseness structure of the present invention is provided on a drum frame and is used to adjust a snare. The drum snare adjuster includes a fixed seat, an actuation column, an actuation handle, a pull-down seat, an adjustment bolt, and a packing assembly. The fixed seat includes an internal space and a lateral hole communicating with the internal space; and the lateral hole includes two snap-in slots located at different height positions. The actuation column is slidably arranged in the internal space, and the actuation handle passes through the lateral hole to connect and fix to the actuation column; and the actuation handle is snapped in any one of the two snap-in slots.

The pull-down seat includes a clamping seat and a non-circular rod body. The clamping seat is used for fixing the snare, and the non-circular rod body passes through the fixed seat and into the internal space in a penetration direction and in a non-rotation manner. The non-circular rod body includes an internal thread hole toward the penetration direction. The adjustment bolt is rotatably fixed to the actuation column, and the adjustment bolt includes a thread section that spirally penetrates into the internal thread hole. The packing assembly is provided between the adjustment bolt and the actuation column, and two ends of the packing assembly press the adjustment bolt and the actuation column.

Accordingly, a friction force between the adjustment bolt and the actuation column can be increased through the packing assembly, and looseness of the adjustment bolt can be avoided.

DETAILED DESCRIPTION OF THE PREFERRED EMBODIMENTS

The technical content, features and effects of the present invention will be clearly described below in combination with the detailed descriptions of preferred embodiments with reference to the drawings.

Figure 1:
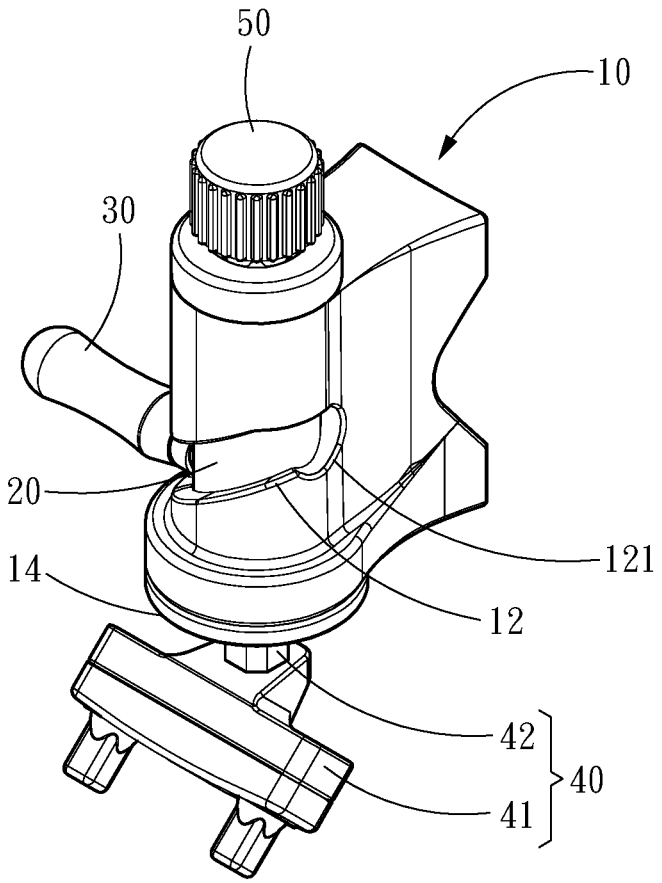
FIG. 1 is a combined structural diagram of the present invention.
Figure 2:
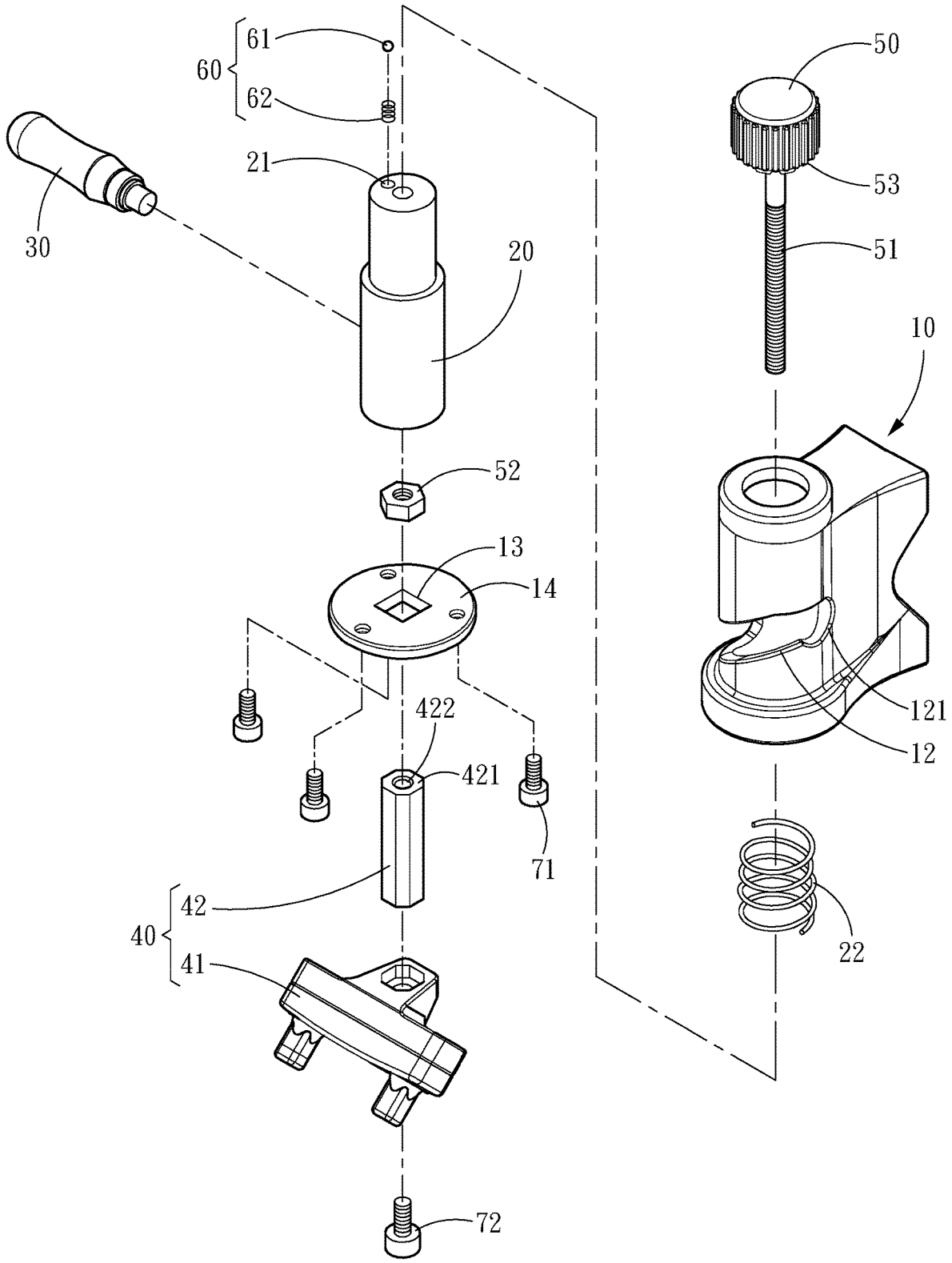
FIG. 2 is an exploded structural diagram of the present invention.
Figure 3:
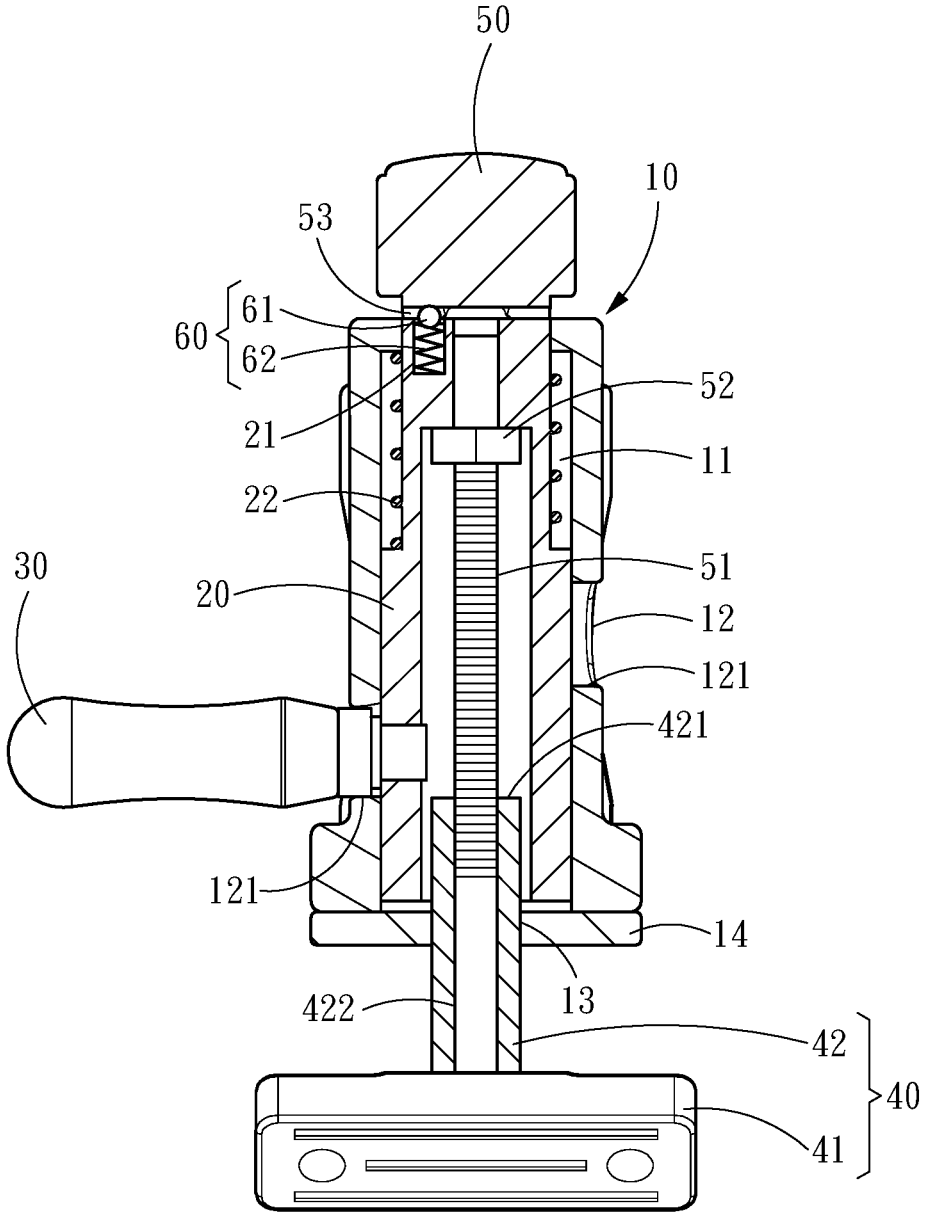
FIG. 3 is a section view of a combined diagram of the present invention.

Referring to FIG. 1, FIG. 2, and FIG. 3, the present invention provides a drum snare adjuster with an anti-looseness structure. The drum snare includes a fixed seat 10, an actuation column 20, an actuation handle 30, a pull-down seat 40, an adjustment bolt 50, and a packing assembly 60. The fixed seat 10 includes an internal space 11 and a lateral hole 12 communicating with the internal space 11, wherein the lateral hole 12 includes two snap-in slots 121 located at different height positions. In one embodiment, a push spring 22 is provided between the fixed seat 10 and the actuation column 20. The push spring 22 pushes the actuation column 20 to move and enable the actuation handle 30 to be snapped in any one of the two snap-in slots 121, so as to avoid the problem of displacement caused by shake of the actuation handle 30 by the thrust of the push spring 22.

The actuation column 20 is slidably arranged in the internal space 11, and the actuation handle 30 passes through the lateral hole 12 to connect and fix to the actuation column 20, and the actuation handle 30 is snapped in any one of the two snap-in slots 121.

The pull-down seat 40 includes a clamping seat 41 and a non-circular rod body 42, and the non-circular rod body 42 passes through the fixed seat 10 and into the internal space 11 in a penetration direction and in a non-rotation manner. In one embodiment, the non-circular rod body 42 includes a non-circular section 421, and the fixed seat 10 includes two non-circular penetrating holes 13 corresponding to the non-circular section 421 and providing for the non-circular rod body 42 to pass through. For example, the non-circular section 421 can be octagonal, and the two non-circular penetrating holes 13 can be quadrilateral. Further for the convenience of assembling, the fixed seat 10 locks a fixed sheet 14 via a plurality of first bolts 71, and the two non-circular penetrating holes 13 are formed in the fixed sheet 14. In addition, the non-circular rod body 42 and the clamping seat 41 can also be combined and fixed via a second bolt 72, which can lower the manufacturing difficulty.

In addition, the non-circular rod body 42 includes an internal thread hole 422 toward the penetration direction. The adjustment bolt 50 is rotatably fixed to the actuation column 20, and the adjustment bolt 50 includes a thread section 51, and the thread section 51 spirally penetrates into the internal thread hole 422. In one embodiment, the thread section 51 screws a nut 52, and the nut 52 presses against an interior of the actuation column 20 to enable the adjustment bolt 50 to be rotatably fixed on the actuation column 20.

The packing assembly 60 is provided between the adjustment bolt 50 and the actuation column 20, and two ends of the packing assembly 60 press the adjustment bolt 50 and the actuation column 20. In one embodiment, the packing assembly 60 includes a steel ball 61 and a pressing spring 62, the adjustment bolt 50 includes a wavy surface 53 pressing against the steel ball 61, and the actuation column 20 includes a groove 21 for placing the pressing spring 62. Therefore, the pressing spring 62 presses the steel ball 61 to contact the wavy surface 53 to increase the friction force between the adjustment bolt 50 and the actuation column 20, and there is no risk of looseness of the adjustment bolt 50 due to long-time vibration.

Figure 4:
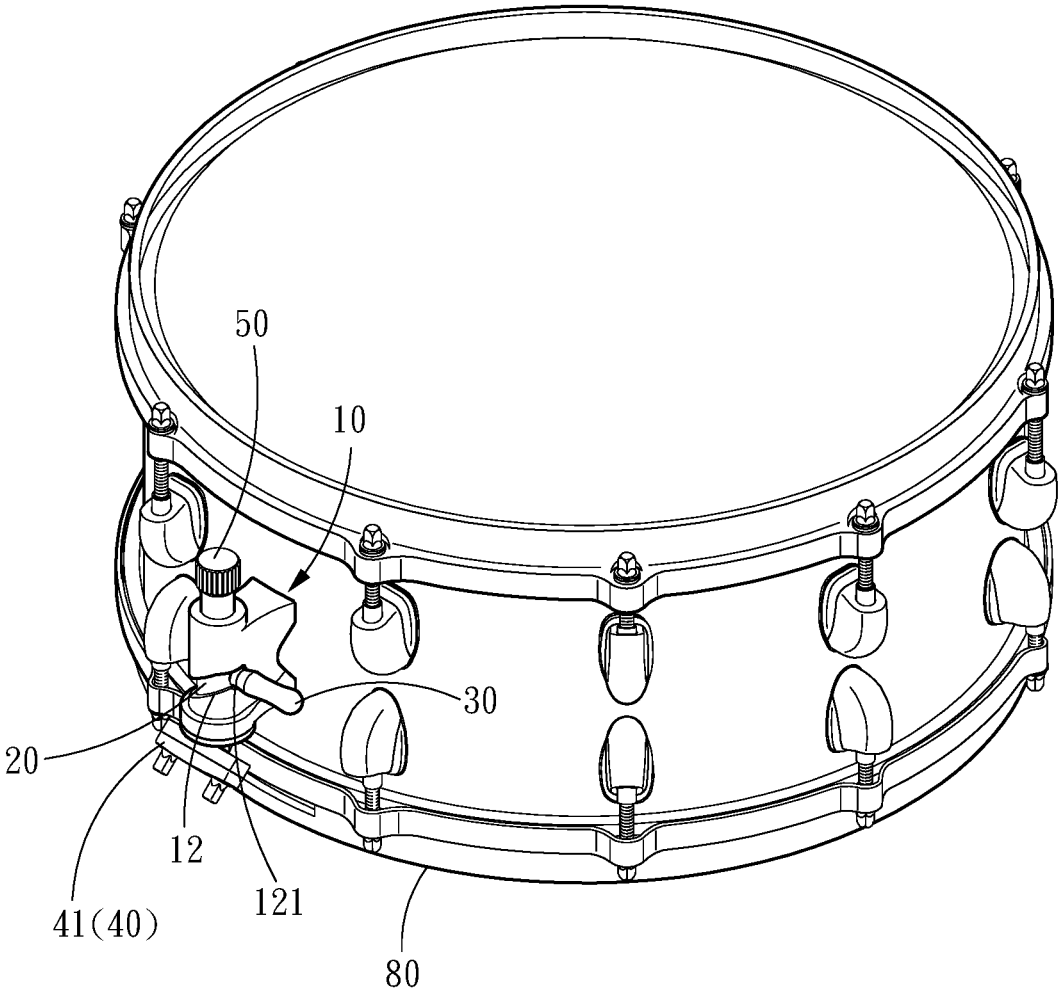
FIG. 4 is a schematic usage diagram of the present invention.
Figure 5:
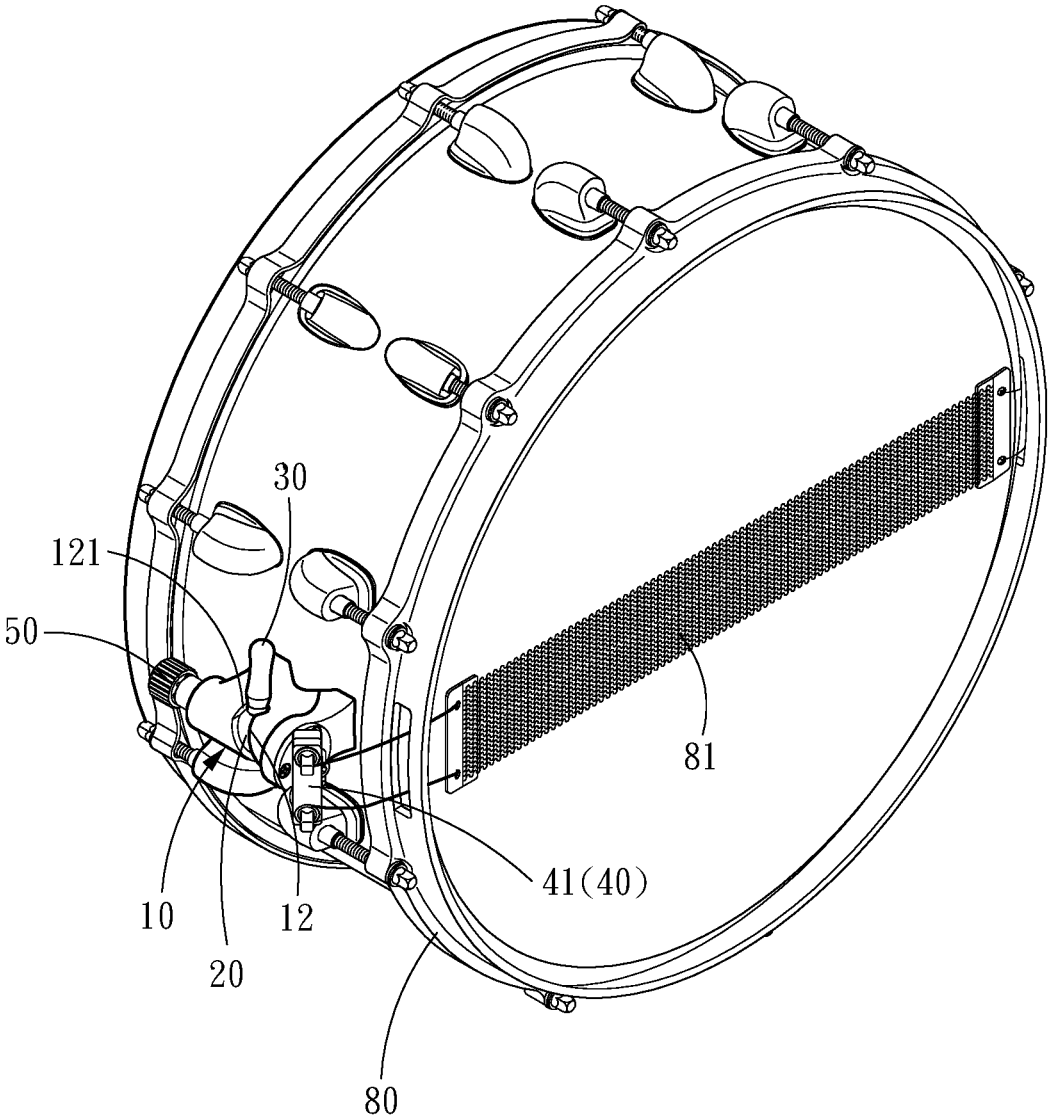
FIG. 5 is a schematic usage diagram of the present invention from another angle.

In addition, referring FIG. 3, FIG. 4, and FIG. 5, the present invention is provided on a drum frame 80 and used to adjust a snare 81. The clamping seat 41 fixes the snare 81. When the actuation handle 30 rotates from the snap-in slot 121 at a relatively low position (as shown in FIG. 1) to the snap-in slot 121 at a relatively high position (as shown in FIG. 4), the actuation handle 30 drives the actuation column 20 to move up, and the actuation column 20 will drive the adjustment bolt 50 to move up, and the adjustment bolt 50 will drive the non-circular rod body 42 (the pull-down seat 40) to move up, so that the snare 81 can be strained. When the adjustment bolt 50 is rotated, the thread section 51 of the adjustment bolt 50 rotates relative to the internal thread hole 422, thus changing a relative position between the non-circular rod body 42 and the adjustment bolt 50 and driving the pull-down seat 40 to move to finely adjust the tightness of the snare 81.

As mentioned above, the present invention at least includes following characteristics:

1. The friction force between the adjustment bolt and the actuation column can be increased through the packing assembly, and looseness of the adjustment bolt can be avoided;

2. By the design of the non-circular rod body, rotation of the pull-down seat can be avoided; and left and right uniform tensions can be provided during fixing of the snare.

What is claimed is:

1. A drum snare adjuster with an anti-looseness structure, provided on a drum frame to adjust a snare, comprising:

a fixed seat, including an internal space and a lateral hole communicating with the internal space, wherein the lateral hole includes two snap-in slots located at different height positions;

an actuation column, slidably arranged in the internal space;

an actuation handle, passing through the lateral hole to connect and fix to the actuation column, wherein the actuation handle is snapped in any one of the two snap-in slots;

a pull-down seat, including a clamping seat used for fixing the snare, and a non-circular rod body passing through the fixed seat and into the internal space in a penetration direction and in a non-rotation manner, and the non-circular rod body includes an internal thread hole toward the penetration direction;

an adjustment bolt, rotatably fixed to the actuation column, and the adjustment bolt includes a thread section that spirally penetrates into the internal thread hole; and a packing assembly, provided between the adjustment bolt and the actuation column, wherein two ends of the packing assembly press the adjustment bolt and the actuation column.

2. The drum snare adjuster according to claim 1, wherein a push spring is provided between the fixed seat and the actuation column, and the push spring pushes the actuation column to move and enable the actuation handle to be snapped in any one of the two snap-in slots.

3. The drum snare adjuster according to claim 1, wherein the non-circular rod body includes a non-circular section, and the fixed seat includes two non-circular penetrating holes corresponding to the non-circular section and providing for the non-circular rod body to pass through.

4. The drum snare adjuster according to claim 3, wherein the non-circular section is octagonal, and the two non-circular penetrating holes are quadrilateral.

5. The drum snare adjuster according to claim 3, wherein the fixed seat locks a fixed sheet via a plurality of first bolts, and the two non-circular penetrating holes are formed in the fixed sheet.

6. The drum snare adjuster according to claim 1, wherein the non-circular rod body and the clamping seat are combined and fixed through a second bolt.

7. The drum snare adjuster according to claim 1, wherein the thread section screws a nut, and the nut presses against an interior of the actuation column to enable the adjustment bolt to be rotatably fixed to the actuation column.

8. The drum snare adjuster according to claim 1, wherein the packing assembly comprises a steel ball and a pressing spring, the adjustment bolt includes a wavy surface pressing against the steel ball, and the actuation column includes a groove for placing the pressing spring.

* * * * *